US006918349B2

(12) United States Patent
Andersson et al.

(10) Patent No.: US 6,918,349 B2
(45) Date of Patent: Jul. 19, 2005

(54) MOBILE PROTECTION SYSTEM

(75) Inventors: Rolf Andersson, Benalmadena (ES); Fredrik Hillelson, Vaxholm (SE); Stig Secund, Valdemarsvik (SE)

(73) Assignee: Safe Barrier International Ltd., Askim (SE)

( * ) Notice: Subject to any disclaimer, the term of this patent is extended or adjusted under 35 U.S.C. 154(b) by 31 days.

(21) Appl. No.: 10/400,502

(22) Filed: Mar. 28, 2003

(65) Prior Publication Data

US 2004/0177799 A1 Sep. 16, 2004

(30) Foreign Application Priority Data

Mar. 12, 2003 (SE) ..... 0300672

(51) Int. Cl.[7] ..... B63B 38/00
(52) U.S. Cl. ..... 114/382; 114/240 E; 114/241
(58) Field of Search ..... 114/222, 382, 114/241, 240 E, 240 D, 240 C, 240 R; 405/63–69

(56) References Cited

U.S. PATENT DOCUMENTS 1,204,547 A * 11/1916 Corrado et al. ..... 114/241
2,383,095 A * 8/1945 Wallace ..... 114/241
RE27,452 E * 8/1972 Smith ..... 405/71
3,680,161 A 8/1972 Bladh
4,337,716 A * 7/1982 Harris ..... 114/222
4,688,024 A * 8/1987 Gadde ..... 340/550
5,071,286 A * 12/1991 Separovich ..... 405/66
5,152,242 A * 10/1992 Bradley ..... 114/222

FOREIGN PATENT DOCUMENTS

DE 3724093 A1 2/1989
JP 10-100991 4/1998

* cited by examiner

*Primary Examiner*—Sherman Basinger
(74) *Attorney, Agent, or Firm*—Sughrue Mion, PLLC

(57) ABSTRACT

The present invention relates to a mobile protection system for moored or anchored ships. The system has a reinforced foldable surface unit and a foldable net unit connected to the surface unit to provide a restricted area. The surface unit prevents small boats from entering the area and the net unit prevents divers from entering the area. The net unit is provided with an alarm to indicate if a diver tries to penetrate the net.

10 Claims, 3 Drawing Sheets

MOBILE PROTECTION SYSTEM

FIELD OF INVENTION

The present invention relates generally to protection systems and particularly to mobile protection systems for moored or anchored ships.

BACKGROUND

There have always been necessary to protect expensive equipment, or in other ways hard to replace equipment, such as ships, especially in troubled times. Particularly small-sized attacks are difficult to stop, such as suicide or terror attacks.

In a home port it is possible to provide satisfactory protection for a ship with different permanent solutions. However, when a ship is not in its home port it is difficult to provide a satisfactory protection for a ship.

Further, it is not necessarily always allowed to set up a permanent installation in a port, due to e.g. diplomatic or environmental reasons. Even if it is possible to set up a permanent installation in a port it is possible that such an approval has been given shortly before a planned visit and a permanent installation usually takes a long time to build.

A further drawback with a permanent installation is that it usually is very expensive.

SUMMARY OF THE INVENTION

An aspect of the present invention is to provide a protection system for moored or anchored ships, which system is mobile.

Another aspect of the present invention is to provide a protection system for moored or anchored ships, which system is flexible.

The basis of the present invention is the knowledge that the above-mentioned objects may be achieved by means of a protection system that is mobile.

An advantage with a mobile protection system according to the present invention is that small-sized attacks are prevented, or at least obstructed to buy time for countermeasures, with a system that is easily moved between different sites and which is easily utilized in different conditions.

According to an embodiment of the present invention the mobile protection system comprises an inflatable surface unit, which may be utilized as per a method allowing a very rapid enclosure of a ship. Specifically, a foldable surface unit, which is arranged to provide an enclosed area and provided with reinforcements to prevent or obstruct unauthorized entry to the enclosed area, is provided. The surface unit is arranged to project as an obstacle from the sea level when the mobile protection system is in use. In addition, a foldable net unit is connected to the surface unit. The net unit provides an enclosed base to the area enclosed by the surface unit to provide a protected space into which unauthorized entry is prevented or obstructed. The net unit includes means to reveal manipulation thereof. The method positions the mobile protection system at the bottom of the sea below a mooring or anchoring site. A ship is moved into the mooring or anchoring site, and the surface unit is moved from the bottom of the sea to the surface of the sea, such that the ship is within the enclosed space.

According to another embodiment of the present invention the mobile protection system is made up of two modules, allowing the system to easily be folded for transportation to a new mooring site. Specifically, a protection module comprises a foldable inflatable surface unit provided with reinforcements, and a foldable net unit connected to the surface unit. The net unit is designed to sense manipulation thereof. The net unit comprises a square-shaped middle part and at opposing ends thereof two square-shaped end parts, and the middle part includes a side portion and a bottom portion. The bottom portion is equal in length with the end part, such that when the bottom portion is folded perpendicular to the side portion and the end part is folded perpendicular to the side portion, an edge of the bottom portion is adjacent an edge of the end part, such that they can be joined together.

Further features and advantages of the present invention will be evident from the following description and subsequent claims.

The present invention will now be described more closely below with reference to the detailed description of embodiments and the appended drawings, which only illustrates and thus not limit the present invention.

DETAILED DESCRIPTION OF EMBODIMENTS

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

Figure 1:
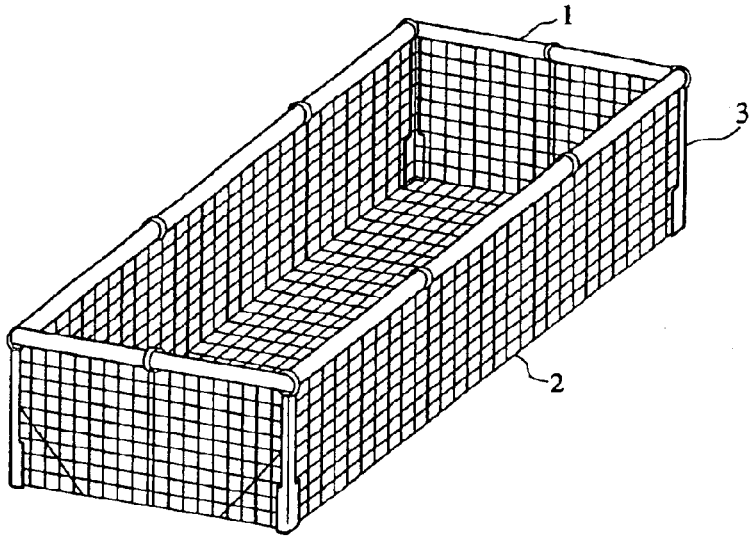
FIG. 1 illustrates a mobile protection system according to the present invention.

A first embodiment of the present invention will now be described with reference to FIG. 1–3.

A mobile protection system comprises a surface unit 1 and a net unit 2 attached to the surface unit. The surface unit 1 includes a buoyant device such as a boom 8, which is reinforced with steel wires 4 running along the boom 8. The boom 8 has a diameter of approximately 1 m, which prevents small boats from crossing the surface unit 1. Further, the boom 8 forms a closed loop, which defines an enclosed area to which unauthorized entry is prevented, or at least obstructed. The form of the loop is preferably square, to provide an area suitable for harboring a ship and which form further is easily foldable, provided that the boom 8 is foldable.

The net unit 2 includes means to reveal manipulation thereof. This may be obtained by a plurality of ways known to the person skilled in the art. However, one limitation to the choice of means is that the net unit 2 needs to be foldable. The net unit 2 is attached to the surface unit 1 along the entire closed loop, thus providing an enclosed base to the area enclosed by the boom 8. The base preferably has a box-formed shape, to easily harbor a ship, which form further is easily foldable.

While the reinforced boom 8 physically prevents a small-sized boat from entering the enclosed area the net unit 2 has more of a delaying function. If a diver tries to penetrate the net unit 2 an alarm will go off, preferably indication the position that has been manipulated. The alarm may also trigger an automatic counter measure, such as a grenade launcher, and/or alarm a human operator that takes appropriate action. However, the net unit 2 is sufficiently reinforced to obstruct penetration and sufficiently pliable to allow the net unit 2 to be folded. The net being e.g. formed as a continuous net made of a rope cable.

Preferably, the surface unit 1 is provided with senor means 5, such as a detector running along the closed boom 8, to detect e.g. a diver trying to climb over the boom 8. Such a sensor means 5 preferably provides an alarm to a human operator.

Figure 2:
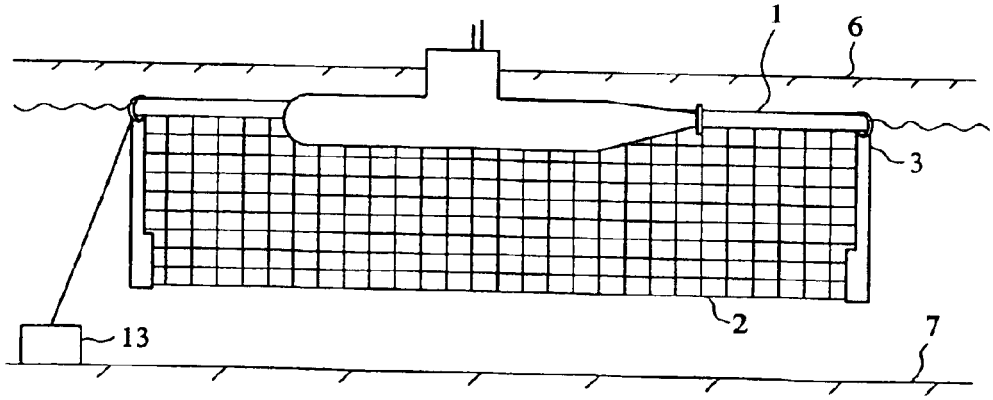
FIG. 2 illustrates a side view of a mobile protection system in use, protecting a submarine moored at a quay.
Figure 3:
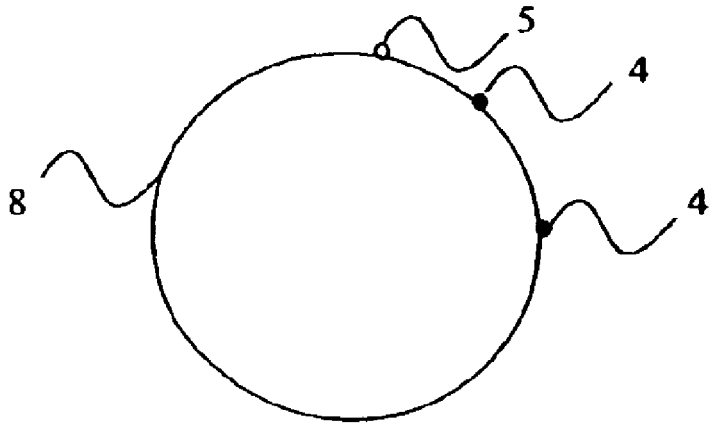
FIG. 3 illustrates a cut through a surface unit according to a preferred embodiment of the present invention.

A protected submarine is illustrated in FIG. 2, where the mobile protection system is positioned at a quay 6 and distanced from the bottom 7 of the sea.

The form of the mobile protection system (MPS) gives several advantages compared to permanent systems. A permanent system needs to be sealed along the bottom of the sea, to prevent a diver from entering. The base of the MPS provides for a solution independent of the structure of the bottom of the sea. A permanent solution may further need to provide a seal deep into the bottom of the sea if the bottom is soft and which therewith may change with time.

If a mooring site that has been protected and for some reason needs to be moved to another site the MPS may be reused at the new site, whereas a permanent system probably is wasted. A permanent system is further more expensive than a MPS.

In a second embodiment of the present invention the boom 8 of the surface unit 1 of the first embodiment is inflatable, such that it may be moved between the bottom and the surface of the sea. Preferably, the boom 8 comprises several inflatable sections, not in communication with each other. This provides for good buoyancy, even if one or more of the sections is damaged or destroyed.

This second embodiment may be utilized to provide a very rapid protective enclosure of a ship. The mobile protection system is positioned on the bottom of the sea under a mooring site. After the ship to be protected has moved into the mooring site the mobile protection system is inflated and thereby lifted to the surface, very rapidly providing a protected space for the ship.

In a third embodiment of the present invention the net unit 2 of the first or second embodiment comprises cage-forming and stabilizing elements 3. These elements 3 are attached primarily to the corners of the cage, and possibly also distributed along the loop, to provide a well-defined form of the net unit, such that a distance between the net unit 2 and the bottom of a protected ship is guaranteed. This distance ensures that a diver will not get closer to the ship than the guaranteed distance.

Preferably, the cage is kept in position by anchoring means 13. Such an anchoring means 13 may provide automatic correction means, which e.g. may adjust an anchoring cable length in dependence on tide.

Figure 4:
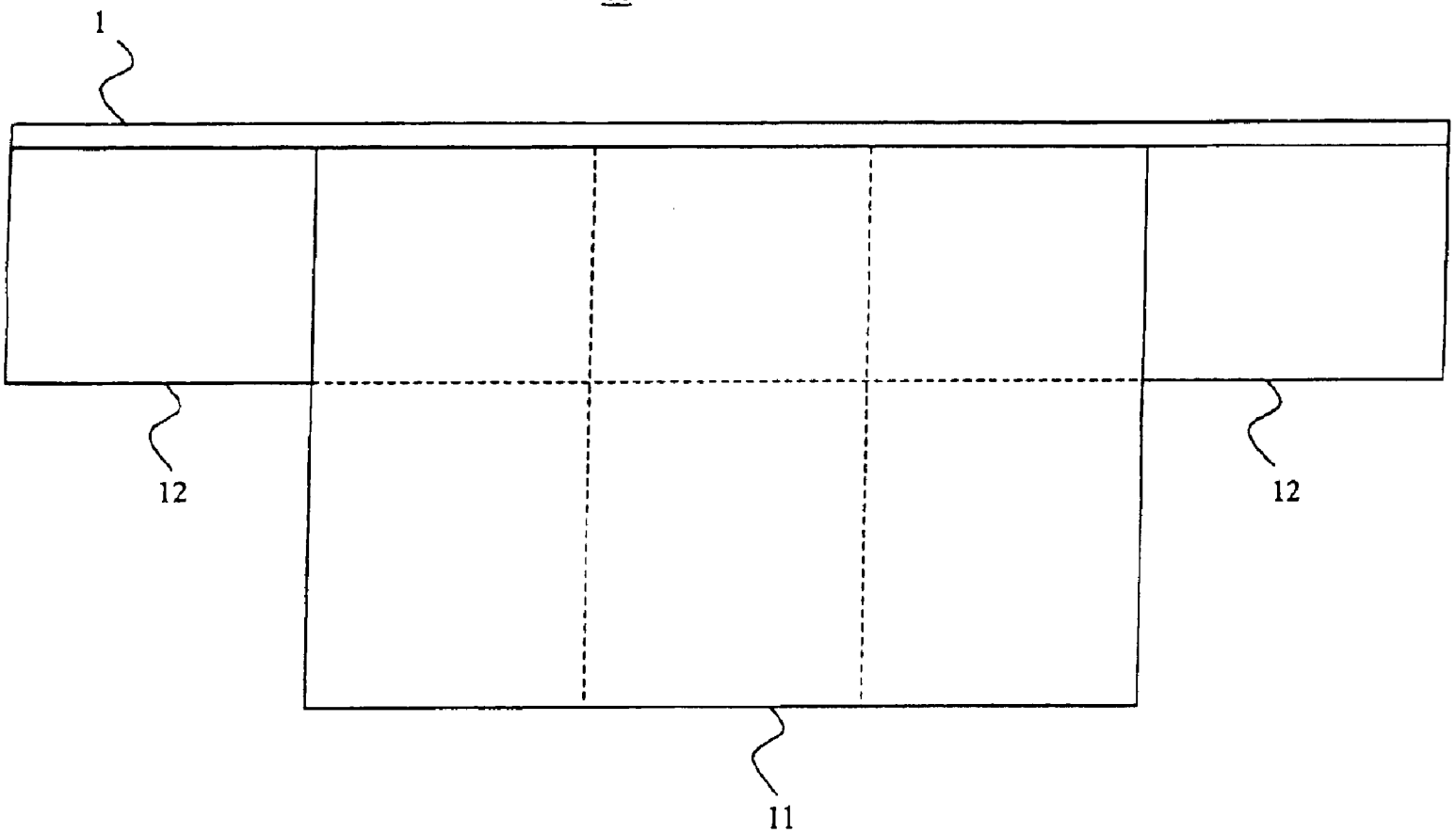
FIG. 4 illustrates a module part according to the present invention.

According to a fourth embodiment of the present invention, illustrated in FIG. 4, the mobile protection system in any of the previous embodiments is made up of two modules 10, each forming half of the system. Each half comprises three net unit parts attached to the surface unit: a middle part 11 and two end parts 12.

The middle part 11 includes a square-shaped net divided into two square-shaped portions: a side portion and a bottom portion. The end parts 12 each include a square-shaped net. A respective edge of the two end parts is attached to opposing edges of the side portion of the middle part. The length of the edges of the end parts are equal to the length of the edges of the bottom portion, such that when the end parts and the bottom portion is folded to form a cage these edges are positioned adjacent each other and are joined together.

Two such modules 10 are joined together to form a mobile protection system.

The middle part 11 is preferably made up of standard sized sections, in FIG. 4 three sections. A suitable size of such a section is 30×40 m, where the side portion takes up 10 of the 40 m and the bottom portion takes up 30 of the 40 m. A suitable size of an end part 12 is 30×10 m, to fit to the middle part 11. A MPS with three sections in the middle part 11 would thus provide a protected area of 5400 $m^2$.

The above-described embodiments have been described in connection with a moored ship. The MPS may also be provided for anchored ships. Such an MPS would need a specially designed opening in the bottom of the net unit to allow an anchor cable through.

It will be obvious that the present invention may be varied in a plurality of ways. Such variations are not to be regarded as departure from the scope of the present invention. All such variations as would be obvious for a person skilled in the art are intended to be included within the scope of the present invention.

What is claimed is:

1. A mobile protection system for moored or anchored ships, wherein said system comprises:

a foldable surface unit, which is inflatable and arranged to provide an enclosed area and provided with reinforcements to prevent or obstruct unauthorized entry to the enclosed area, wherein the surface unit is arranged to project as an obstacle from the sea level when the mobile protection system is in use, and a foldable net unit connected to the surface unit, which net unit is designed to provide an enclosed base to the area enclosed by the surface unit to provide a protected space into which unauthorized entry is prevented or obstructed, and which net includes means to reveal manipulation thereof.

2. The mobile protection system as claimed in claim 1, wherein said surface unit and said net unit are arranged in two modules, each foldable to fit into a transport trailer.

3. The mobile protection system as claimed in claim 1, wherein said surface unit is divided into several separate inflatable sections.

4. The mobile protection system as claimed in claim 1, comprising cage-forming and stabilizing elements attached to said net unit, in order to provide a certain distance between the net unit and the bottom of a ship within said enclosed space.

5. The mobile protection system as claimed in claim 1, comprising anchoring means to fix said system to the bottom of the sea.

6. The mobile protection system as claimed in claim 1, comprising sensor means provided on said surface unit.

7. A protection module for moored or anchored ships, wherein said module comprises:

a foldable inflatable surface unit provided with reinforcements, and a foldable net unit connected to the surface unit, which net unit is designed to sense manipulation thereof, wherein said net unit comprises a square-shaped middle part and at opposing ends thereof two square-shaped end parts, and wherein said middle part includes a side portion and a bottom portion, said bottom portion being equal in length with said end part, such that when said bottom portion is folded perpendicular to said side portion and said end part is folded perpendicular to said side portion an edge of said bottom portion is adjacent an edge of said end part, such that they can be joined together.

8. The protection module as claimed in claim 7, wherein said middle part comprises one or more standard-sized lengths joined together.

9. A method for protecting moored or anchored ships, wherein said protection is obtained by a mobile protection system comprising a surface unit, providing an enclosed area, and a net unit, attached to the surface unit, providing an enclosed base to the area enclosed by the surface unit, wherein said method comprises:

positioning the system at the bottom of the sea below a mooring or anchoring site, wherein said position comprises;

releasing air from said surface unit, moving said system from the surface of the sea to the bottom of the sea, and fastening said system to the bottom of the sea, moving a ship into said mooring or anchoring site, and moving the surface unit from the bottom of the sea to the surface of the sea, such that The ship is within the enclosed space, wherein moving the surface unit comprises:

unfastening said system from the bottom of the sea, and inflating said surface unit, such that said surface unit moves to the surface of the sea.

10. The method as claimed in claim 9, wherein moving the surface unit from the bottom of the sea comprises moving the surface unit from the bottom of the sea to the surface of the sea, such that said net unit is distanced from the bottom of the sea.

* * * * *